US008857097B2

(12) United States Patent
Rorick

(10) Patent No.: US 8,857,097 B2
(45) **Date of Patent: *Oct. 14, 2014**

(54) QUICK DETACHABLE FIREARM ACCESSORY MOUNT

(71) Applicant: Steven M. Rorick, Riverside, CA (US)

(72) Inventor: Steven M. Rorick, Riverside, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/896,602

(22) Filed: May 17, 2013

(65) Prior Publication Data

US 2013/0312309 A1 Nov. 28, 2013

Related U.S. Application Data

(63) Continuation-in-part of application No. 13/896,200, filed on May 16, 2013.

(60) Provisional application No. 61/650,118, filed on May 22, 2012, provisional application No. 61/670,184, filed on Jul. 11, 2012.

(51) Int. Cl.
*F41C 27/00* (2006.01)
*F41G 11/00* (2006.01)

(52) U.S. Cl.
CPC ..... *F41G 11/003* (2013.01); *F41C 27/00* (2013.01)
USPC ..... 42/114; 42/127; 42/146; 42/148

(58) Field of Classification Search
CPC ... F41G 11/001; F41G 11/003; F41G 11/005; F41G 11/006; F41G 11/007; F41G 11/008
USPC ..... 42/124, 127, 148, 114, 146; 248/689
See application file for complete search history.

(56) References Cited

U.S. PATENT DOCUMENTS

| | | | | | |
|---|---|---|---|---|---|
| 2,401,825 | A | * | 6/1946 | Gruver | 42/127 |
| 2,836,895 | A | | 6/1958 | Dillon | |
| 3,153,856 | A | * | 10/1964 | Felix | 42/127 |
| 3,405,448 | A | * | 10/1968 | Weatherby | 42/127 |
| 5,155,915 | A | | 10/1992 | Repa | |
| 5,396,725 | A | | 3/1995 | Talbot | |
| 5,430,967 | A | * | 7/1995 | Woodman et al. | 42/114 |

(Continued)

FOREIGN PATENT DOCUMENTS

DE 202011102875 U1 10/2011

OTHER PUBLICATIONS

Copenheaver, Blaine R., PCT Written Opinion of the International Searching Authority, Sep. 23, 2013, pp. 1-8.

(Continued)

*Primary Examiner* — Bret Hayes
(74) *Attorney, Agent, or Firm* — Stetina Brunda Garred & Brucker

(57) ABSTRACT

A quick detachable mount is disclosed, wherein the quick detachable mount can be operated with one hand for mounting or detaching the mount from a mounting location (e.g. picatinny rail). The quick detachable mount has a button that can be depressed with the user's thumb while the user's index or middle finger are on the opposite side of the mount (or vice versa). The button when depressed moves a wedge to allow for a pivoting jaw to rotate toward a disengaged position. When the button is released, the wedge contacts the pivoting jaw to traverse the pivoting jaw toward the engaged position.

12 Claims, 10 Drawing Sheets

(56) References Cited

U.S. PATENT DOCUMENTS

| | | | | |
|---|---|---|---|---|
| 5,680,725 | A * | 10/1997 | Bell | 42/127 |
| 6,449,893 | B2 * | 9/2002 | Spinner | 42/127 |
| 6,922,931 | B2 | 8/2005 | Bauer et al. | |
| 6,922,934 | B1 * | 8/2005 | Huan | 42/127 |
| 7,308,772 | B1 | 12/2007 | Millett | |
| 7,735,255 | B1 | 6/2010 | Kincaid et al. | |
| 7,739,824 | B1 | 6/2010 | Swan | |
| 8,128,047 | B1 | 3/2012 | Larue | |
| 8,336,247 | B2 | 12/2012 | Haering | |
| 2004/0128900 | A1 * | 7/2004 | Chen et al. | 42/85 |
| 2005/0246936 | A1 * | 11/2005 | Kay | 42/146 |
| 2005/0257415 | A1 * | 11/2005 | Solinsky et al. | 42/146 |
| 2006/0104064 | A1 * | 5/2006 | Sharrah et al. | 362/287 |
| 2006/0242882 | A1 * | 11/2006 | Liu | 42/146 |
| 2006/0265930 | A1 | 11/2006 | Woodbury | |
| 2007/0033852 | A1 | 2/2007 | Adams | |
| 2007/0193103 | A1 * | 8/2007 | Cheng | 42/111 |
| 2008/0120891 | A1 * | 5/2008 | Wei | 42/90 |
| 2008/0178511 | A1 | 7/2008 | Storch | |
| 2010/0107467 | A1 * | 5/2010 | Samson et al. | 42/127 |
| 2011/0167703 | A1 * | 7/2011 | Deros | 42/90 |
| 2012/0210624 | A1 * | 8/2012 | Schneider et al. | 42/90 |
| 2013/0312307 | A1 * | 11/2013 | Rorick | 42/90 |

OTHER PUBLICATIONS

Brownells, Picatinny Rads, Weaver Rails What's the Difference?, http://www.brownells.com/.aspx/lid=10724/guntechdetail/ Picatinny_Rails_Weaver_Rails_What_s_The_Difference$_{13}$.

Copenheaver, Blaine R., PCT Written Opinion of the Internationai Searching Authority, Sep. 23, 2013, pp. 1-8.

Brownells, Plcatinny Rails, Weaver Rails, What's the Difference?, http://www.brownells.com/.aspx/lid=10724/guntechdetail/ Picatinny_Rails_Weaver_Rails_What_s_The_Difference_.

* cited by examiner

QUICK DETACHABLE FIREARM ACCESSORY MOUNT

CROSS-REFERENCE TO RELATED APPLICATIONS

This application is a continuation in part application of U.S. patent application Ser. No. 13/896,200 filed on May 16, 2013, which claims the benefit of U.S. provisional application Ser. No. 61/650,118, filed on May 22, 2012 and U.S. provisional application Ser. No. 61/670,184, filed Jul. 11, 2012, the entire contents of which are expressly incorporated herein by reference.

STATEMENT RE: FEDERALLY SPONSORED RESEARCH/DEVELOPMENT

Not Applicable

BACKGROUND

The embodiments described herein relate to a quick detachable mount for a picatinny rail.

Many clamping devices exist for firearms that retain a scope or a flashlight to the firearm. By way of example and not limitation, U.S. Pat. No. 5,155,915 discloses a telescopic sighting mount which uses a lever arm to secure the mount to the rail. U.S. Pat. Nos. 5,680,725 and 7,308,772 also disclose a mount for a firearm. The mount uses a mechanical screw to provide the locking force to secure the mount onto the firearm. U.S. Pat. No. 6,449,893 also discloses a mounting apparatus which uses a custom guide track and uses downward forces to push the mount onto the custom guide track. The custom guide track has a plurality of notches where the user must place the mount between the notches to engage the mount. This mount is susceptible to being dislodged upon recoil of the firearm.

Accordingly, there is a need in the art for an improved mount.

BRIEF SUMMARY

The various embodiments and aspects of the quick detachable mount described herein address the needs discussed above, discussed below and those that are known in the art.

In particular, the quick detachable mount has a button that is configured to operate a wedge. The wedge interacts with a pivoting jaw so as to lock the pivoting jaw in the engaged position when the button is released and to allow the wedge to pivot to its normally biased disengaged position when the user depresses the button thereby traversing the wedge away from the pivoting jaw. The button is operable with one hand to allow for quick and easy mounting and detachment of the quick detachable mount from a rail.

More particularly, a quick detachable firearm accessory mount is disclosed which comprises a dovetail mount wherein at least one side of the dovetail moves. The moving side may be held with a spring. Also, the moving dovetail may be locked with a wedge.

The quick detachable firearm accessory mount may be configured for a scope, camera, flashlight or laser sight.

Movement of the moving side may be accomplished with a push button. The push button may be side mounted. Alternatively, the push button may be front or back mounted.

In another aspect, a quick detachable mount removably attachable to a rail is disclosed. The mount may comprise a body, a first jaw, a second jaw and a wedge. The first jaw may be attached to the body. The second jaw may be pivotally attached to the body between an engaged position and a disengaged position. The wedge may have an angled surface wherein the wedge is traversable between an in-position and an out-position. The angled surface may be in sliding contact with the second jaw to traverse the second jaw from the disengaged position to the engaged position as the wedge is traversed from the out-position to the in-position.

The second jaw may be biased to the disengaged position. The second jaw may be biased toward the disengaged position with a spring. The spring that biases the second jaw to the disengaged position may be a torsion spring which has first and second legs. The first leg may press against the second jaw. The second leg of the torsion spring may press against the body to bias the second jaw to the disengaged position.

The wedge may be biased toward the in-position with a spring. The spring that biases the wedge may be a compression coil spring.

The mechanism may further comprise a depressible button and a shaft. The wedge and the second jaw may be disposed on a first side of the body. The button may be disposed on a second opposed side of the body. The depressible button may be biased with a compression coil spring toward a non-depressed state. The shaft may extend through the body and be attached to the wedge and the depressible button to traverse the wedge from the in-position to the out-position when the depressible button is depressed from the non-depressed state to a depressed state.

As an alternative arrangement to the depressible button described above, the depressible button may be disposed on a first surface of the body between the first and second jaws. A second surface of the body opposite the first surface may be configured so that the user may depress the button by gripping the button and the second surface to open the second jaw. The second surface may be flat and parallel to the first surface.

The angled surface of the wedge may have a curved cross sectional configuration, a straight cross sectional configuration, or a cross sectional configuration having at least two different flat angled surfaces. Additionally or alternatively, a mating contact surface of the pivoting second jaw which contacts the angled surface may have a curved cross sectional configuration, a straight cross sectional configuration, or a cross sectional configuration having at least two different flat angled surfaces.

A mating contact surface of the pivoting second jaw may contact the angled surface. The mating contact surface may define first and second angled surfaces which are at a sufficient angle so that the contact surface of the wedge mates with and wedges against the first angled surface of the pivoting second jaw when the wedge is disposed in the in-position and the pivoting second jaw is in the engaged position, and the pivoting jaw clears the wedge when the pivoting jaw is disposed in the disengaged position and the wedge is in the disengaged position. The angled surface of the wedge and a travel direction of the wedge may form an angle of about 5 degrees to 20 degrees, and preferably is at 7 degrees.

Optionally, the mechanism may further comprise a detent disposed between the first and second jaws under the mount. The detent may be depressible between a normally biased out-position and a depressed position. The detent may have a lower width smaller than a width of a groove of a picatinny rail and an upper width greater than the width of the groove of the picatinny rail so that upon mounting the mechanism to the picatinny rail, the detent is depressed until the width of the detent matches the width of the groove of the picatinny rail.

Optionally, the mechanism alternatively may have a detent disposed between the first and second jaws under the mount.

The detent may have a fixed portion and a depressible portion traversable between a normally biased out-position and a depressed position. The fixed portion and the depressible portion collectively may have a lower width smaller than a width of a groove of a picatinny rail and an upper width greater than the width of the groove of the picatinny rail so that upon mounting the mechanism to the picatinny rail, the fixed portion is fully inserted between traversable ridges of the picatinny rail and the depressible portion is depressed until the width of the fixed and depressible portions match the width of the groove of the picatinny rail.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
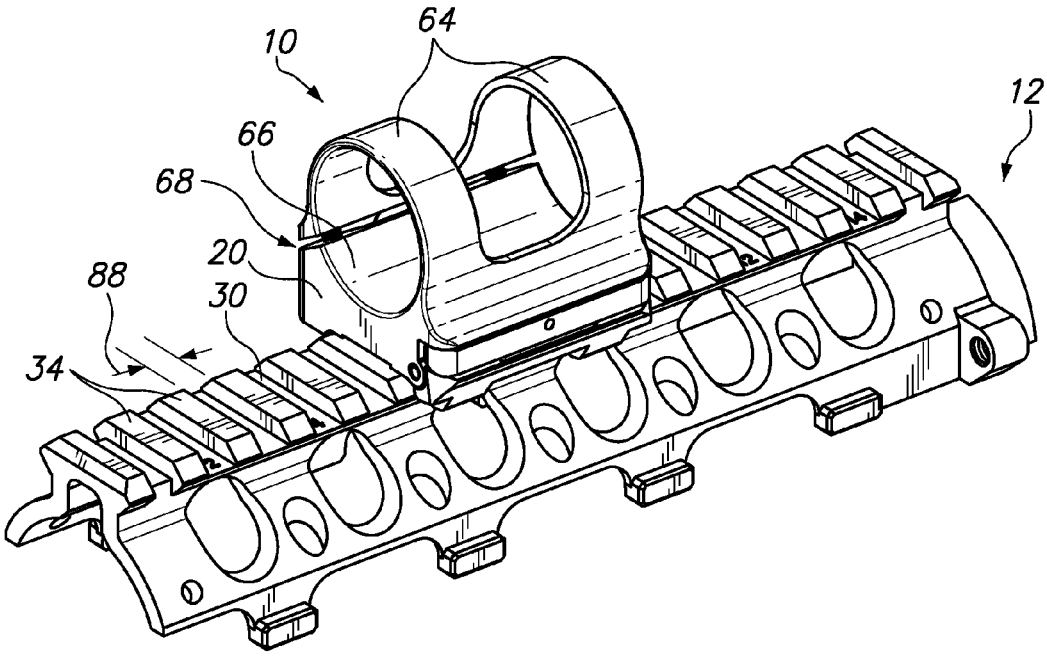
FIG. 1 is a perspective view of a first embodiment of a quick detachable mount mounted to a rail.

Referring now to the drawings, a quick detachable accessory mount 10 for a firearm is shown. The quick detachable mount 10 is removably attachable to a rail 12 of the firearm with one hand by simply pushing a button 14. A thumb 16 of the user may be placed in a crevice 18 (see FIG. 3) formed on a body 20 of the quick detachable mount 10 while the index or middle finger 22 depresses the button 14 (or vice versa) to traverse a wedge 22 outward. The wedge 22 is moved out of the way so that a pivoting jaw 24 can pivot to a disengaged position to release the quick detach mount 10 from the rail 12 of the firearm. The pivoting jaw 24 and the stationary jaw 26 together limit lateral movement of the quick detachable mount 10 on the rail 12 when the quick detachable mount 10 is mounted to the rail 12 of the firearm. Longitudinal movement of the quick detachable mount 10 may be limited on the rail 12 by way of a detent 28 that is inserted in one of a plurality of grooves 30 formed on the rail 12. Accordingly, the quick detachable mount 10 can be adjusted, secured and removed from the rail 12 with one hand. The quick detachable mount 10 is currently shown with a flashlight attachment mechanism that can secure a flashlight to the quick detachable mount 10 which then is securable to the rail 12. However, other types of attachment mechanisms for other devices are also contemplated.

More particularly, referring now to FIG. 1, the quick detachable mount 10 is mountable and removable from the rail 12 quickly with one hand. Moreover, the quick detachable mount 10 may be positioned anywhere along the length of the rail 12 as needed or desired by the user. The rail 12 may have a plurality of transverse ridges 34 extending along the length of the rail 12. These transverse ridges 34 are separated from each other to form the grooves 30. When viewed from the front, as shown in FIG. 3, the ridges have opposed extensions 36 which are gripped by the jaws 24, 26.

Figure 2:
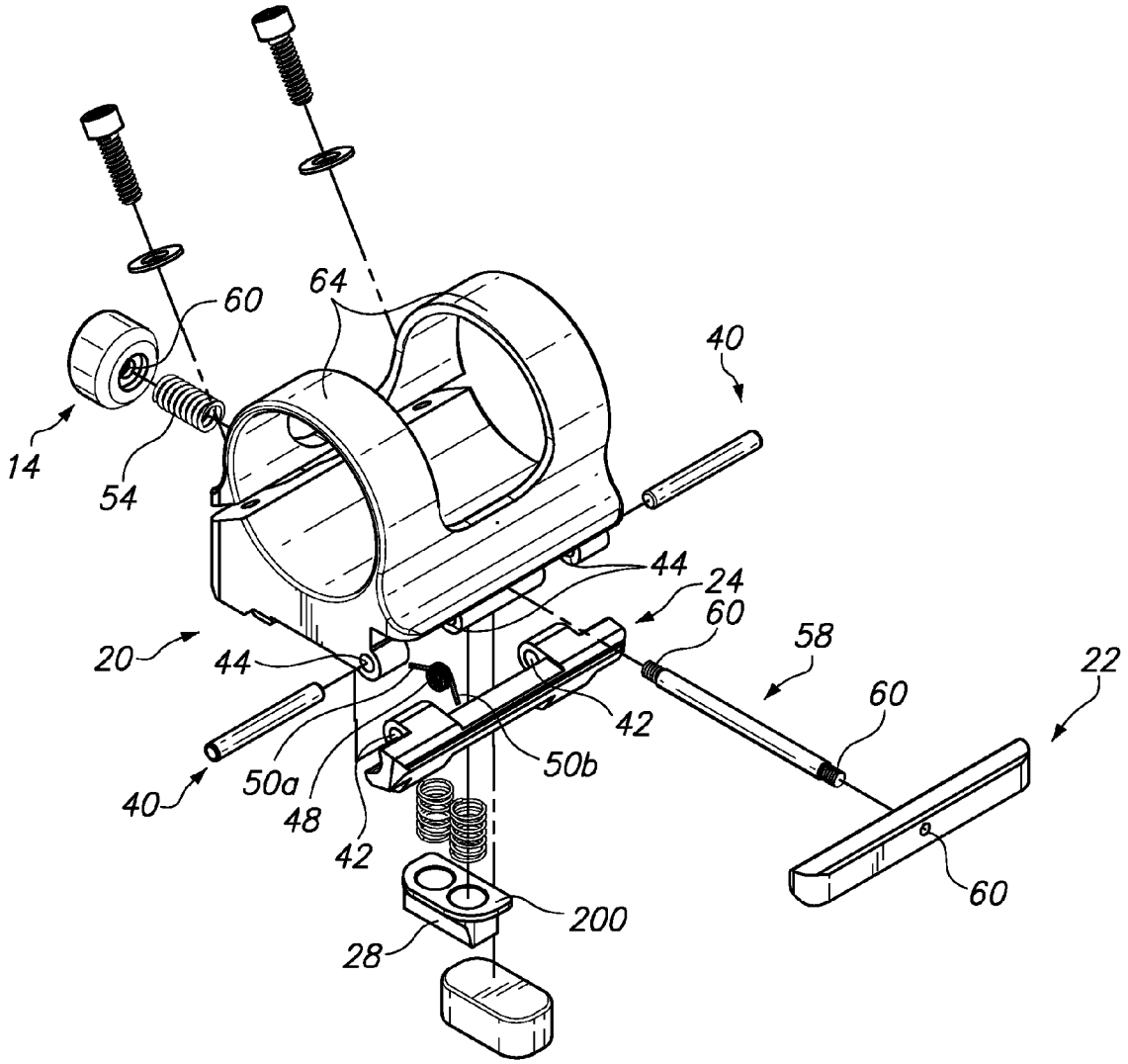
FIG. 2 is an exploded perspective view of the first embodiment of the quick detachable mount shown in FIG. 1.

The jaw 26 is integrally formed with the body 20 and may have a V-shaped configuration 38. The extensions 36 and jaws 24, 26 may have a dovetail configuration. The V-shaped configuration 38 engages the extensions 36 of the transverse ridges 34. On the opposed side of the body 20, the pivoting jaw 24 is mounted to the body 20 by way of pin 40. The pivoting jaw 24 may have two mounting holes 42 (see FIG. 2) which are alignable to mounting holes 44 formed in the body 20. After aligning the mounting holes 42 of the pivoting jaw 24 to the mounting holes 44 formed in the body 20, the pins 40 are inserted into the mounting holes 42, 44. The pins 40 may be retained in the holes 42, 44 by way of one or more methods known in the art or developed in the future such as swaging or placing a set screw to hold the pins 40 in place.

Figure 3A:
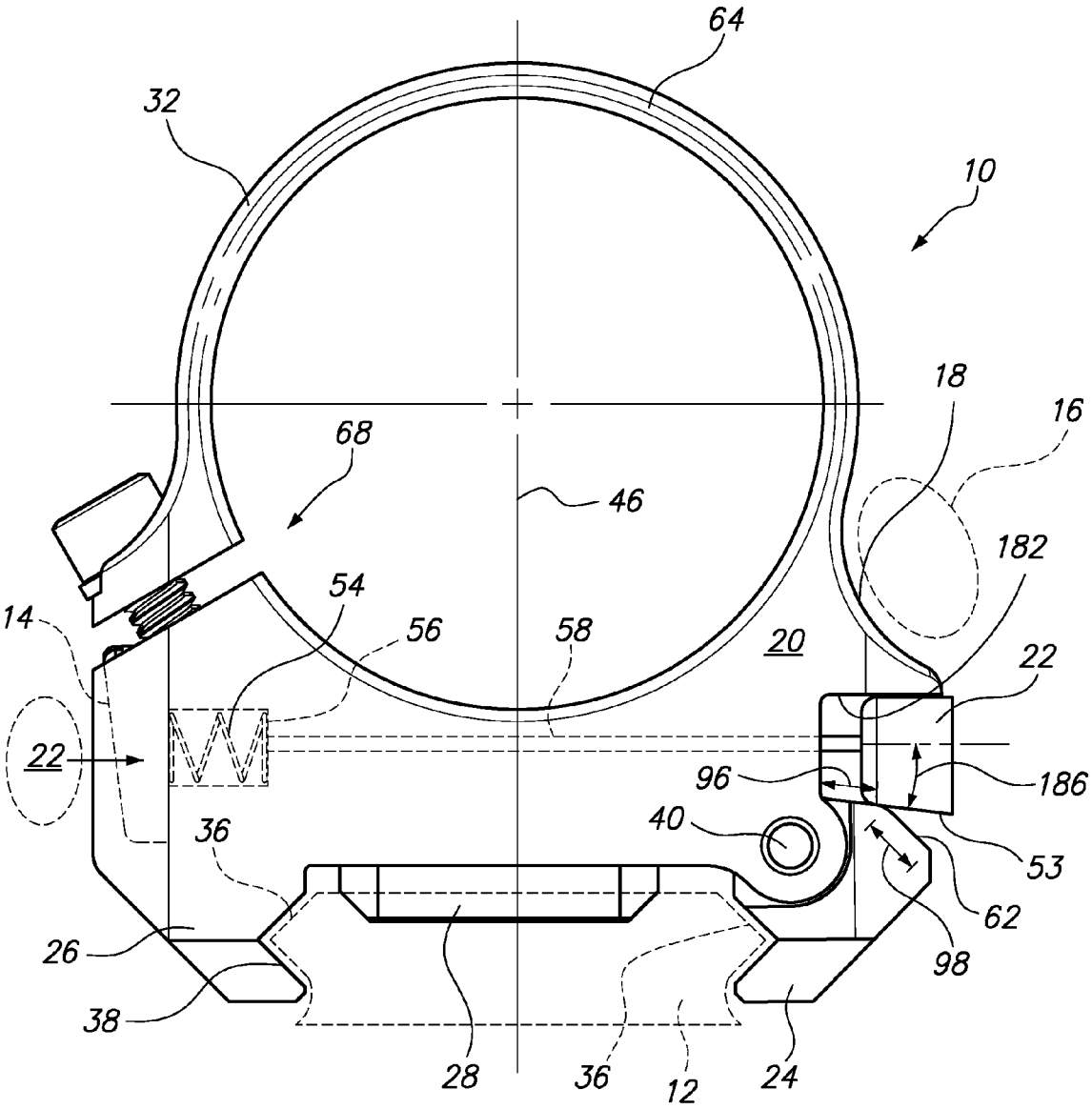
FIG. 3A is a front view of a pivoting jaw and wedge wherein the pivoting jaw is in the engaged position and the wedge is in the in-position.
Figure 3B:
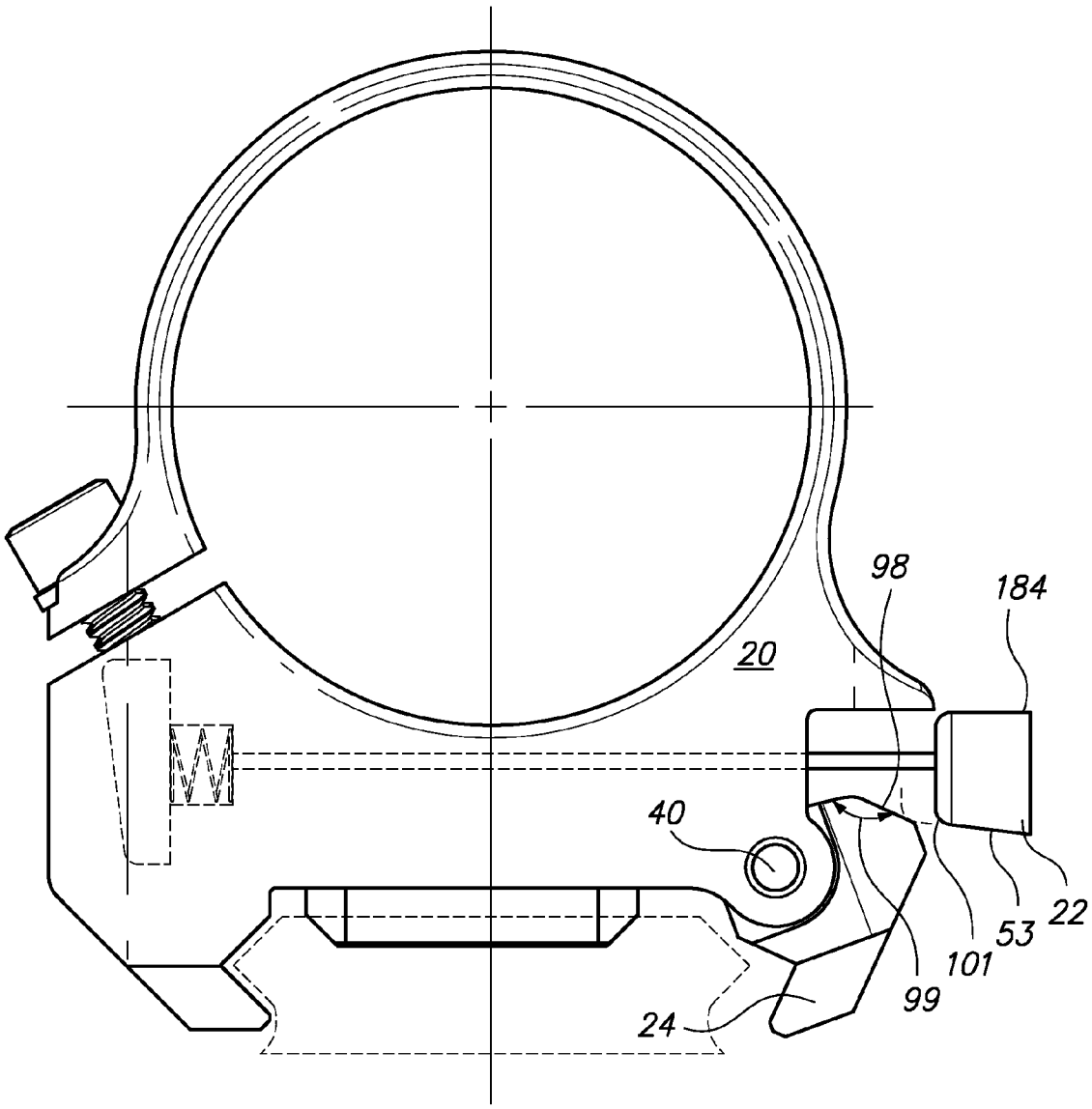
FIG. 3B is a front view of the pivoting jaw and the wedge wherein the pivoting jaw is in the disengaged position and the wedge is in the out-position.

Referring to FIG. 3, the pivoting jaw 24 may be symmetrical with the stationary jaw 26 about a vertical centerline 46 of the quick detachable mount 10. The pivoting jaw 24 has two different positions, namely, an engaged position which is shown in FIG. 3A and the disengaged position shown in FIG. 3B. The pivoting jaw 24 is biased to the disengaged position by way of a torsion spring 48 (see FIGS. 2 and 4). The torsion spring 48 has two legs 50*a, b*. The leg 50*a* resides within a groove 52*a* formed in the body 20 while the other leg 50*b* resides in a groove 52*b* formed in the pivoting jaw 24. When the pivoting jaw 24 is in the engaged position shown in FIG. 3A, the torsion spring 48 is compressed and biases the pivoting jaw 24 out toward the disengaged position shown in FIG. 3B.

The pivoting jaw 24 is traversed from the normally biased disengaged position to the engaged position by way of wedge 22. The wedge 22 is traversable between the in-position shown in FIG. 3A and the out-position shown in FIG. 3B. When the wedge 22 is traversed to the out-position, as shown in FIG. 3B, the wedge 22 is moved out of the way and makes room for the pivoting jaw 24 to pivot upward. When the wedge 22 is traversed to the in-position, the engaging surface 54 of the wedge 22 pushes the pivoting jaw 24 to the engaged position. Moreover, the wedge 22 is held securely in place between the pivoting jaw 24 and the body 20.

Figure 5:
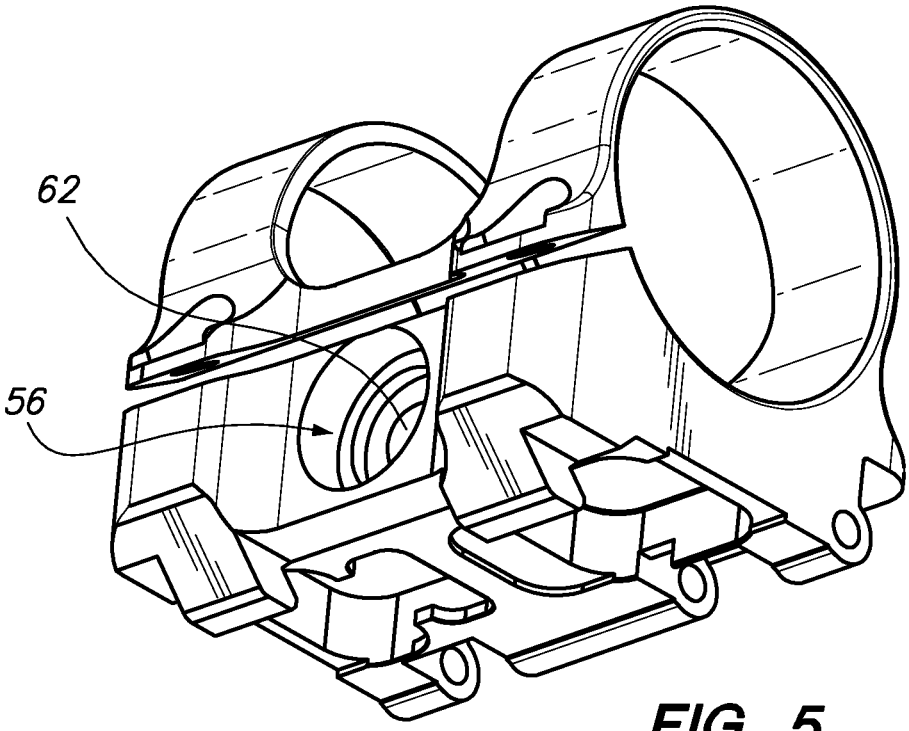
FIG. 5 is a bottom perspective view of a stripped version of the first embodiment of the quick detachable mount shown in FIG. 1.

The wedge 22 is biased to the in-position by way of spring 54. The spring 54 is seated in the body 20 of the quick disconnect mount 10, and more particularly is seated in the cavity 56 shown in FIG. 5. The spring 54 is a compression coil spring that pushes the button 14 outward. A shaft 58 is attached to both the wedge 22 and the button 14 by way of threaded connection 60. The shaft 58 is disposed within a through hole 62 (see FIG. 5) that extends through the body 20 so that depressing the button 14 against the biasing force of the spring 54 pushes or traverses the wedge 22 from the in-position to the out-position. Also, upon release of the button 14, the spring 54 traverses the wedge 22 from the out-position to the in-position. Simultaneously, the contact surface 53 of the wedge 22 pushes the mating contact surface 62 of the pivoting jaw 24 so as to pivot the pivoting jaw 24 to the engaged position.

When the pivoting jaw 24 is in the engaged position, the wedge 22 is disposed between the lower surface 182 of the body 20 and the mating contact surface 62 of the pivoting jaw 24. The lower surface 182 of the body 20 contacts the upper surface 184 of the wedge 22 wherein the lower surface 182 and the upper surface 184 are both parallel to the direction of travel of the wedge 22 between the in and out-positions. Moreover, the contact surface 53 of the wedge 22 and the mating contact surface 62 remain in contact with each other. The contact surface 53 defines an angle 186 with respect to the direction of travel of the wedge 22. The direction of travel of the wedge 22 is parallel to the shaft 58. The angle 186 may be between 5 degrees to 20 degrees and is preferably about 10 degrees. The angle 186 is sufficiently shallow so that the any movement of the mount 20 that applies a force to the pivoting jaw 24 to urge the pivoting jaw 24 toward the disengaged position is insufficient to push the wedge 22 toward the out-position.

The mating contact surface 62 is formed by first and second surfaces 96, 98 which are both generally flat but set at an angle 99 (see FIG. 3B) from each other. When the wedge 22 is in the out-position shown in FIG. 3B, the bottom corner 101 of the wedge 22 is aligned to contact and hit the second surface 98 as the wedge 22 travels from the out-position to the in-position. The bottom corner 101 of the wedge 22 contacts the second surface 98 and pushes the pivoting jaw 24 toward the engaged position. Eventually, the bottom corner 101 or the bottom surface 53 of the wedge 22 contacts the first surface 96 (see FIG. 3A). At this point, the first surface 96 mates with the contact surface 53 of the wedge 22. The pivoting jaw 24 is rotated inward until the pivoting jaw 24 is snugly fitted onto the rail. If the pivoting jaw 24 is pivoted upward, the shallow angle 186 of the contact surface 186 prevents forces imposed on the pivoting jaw 24 from inadvertently pushing the wedge 22 toward the out-position. To release the mount from the rail, the button 14 is depressed which traverses the wedge 22 to the out-position. When the wedge 22 is in the out-position, as shown in FIG. 3B, the pivoting jaw 24 has sufficiently space to pivot to the disengaged position. The second surface 98 is shaped so that the wedge 22 does not interfere with the pivoting jaw 24 when the pivoting jaw 24 moves upward as shown in FIG. 3B. The first and second surfaces 96, 98 are shown as being two generally flat surfaces set at an angle 99 to each other. However, it is also contemplated that the first and second surfaces 96, 98 may be blended to form a compound curve. In particular, the curve is steeper as it extends away from the pin 40.

The quick disconnect mount 10 may be capable of mounting a flashlight to the rail 12. In particular, the body 20 of the quick disconnect mount 10 may be formed with two straps 64. The straps 64 and the exterior surface 66 of the body 20 may be formed with a circular configuration to wrap around a body of the flashlight. The straps 64 are split 68 from the body 20 at one end. The body 20 and the straps 64 may be fabricated from unitary material but the straps 64 may still be flexible by fabricating the body 20 from aluminum or other equivalent material. The straps 64 are sufficiently thin so that the straps 64 may be bent to tighten onto the body of the flashlight with screws.

Figure 10:
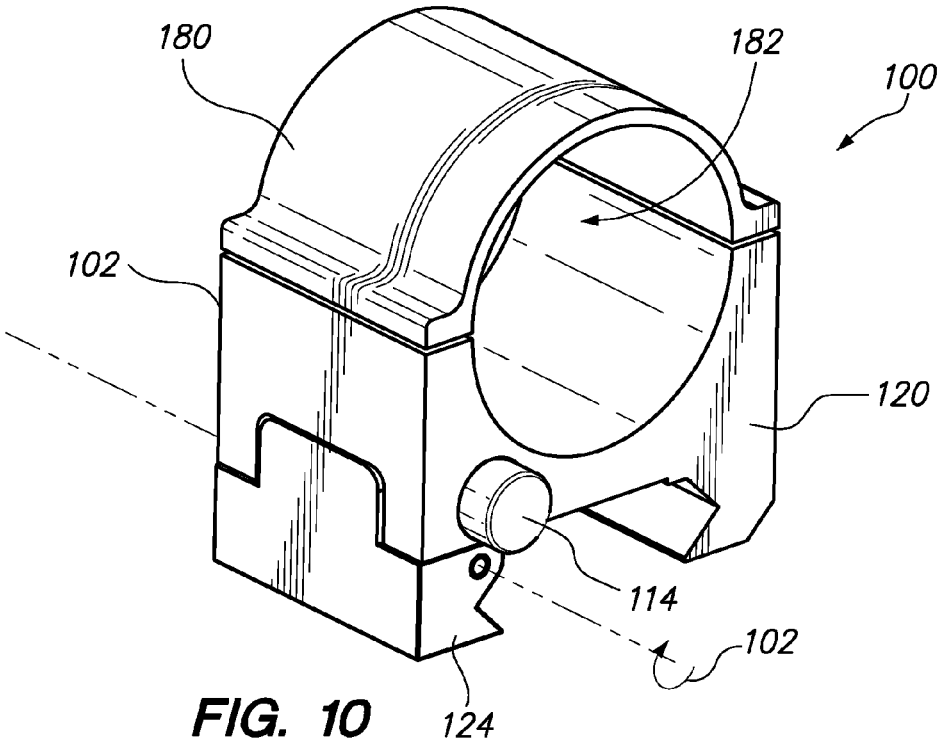
FIG. 10 is a perspective view of a second embodiment of the quick detachable mount.

Referring now to FIG. 10, it is also contemplated that the straps 64 may be replaced with a mounting hardware 180 which forms an internal cavity 182 which is sized and configured to fit a component to be mounted to the rail 12. The mounting hardware 180 and the body 120 may collectively form a cylindrical cavity 182 for mounting to a flashlight or other component (e.g., scope, optics) related to firearms or other industries.

Figure 4:
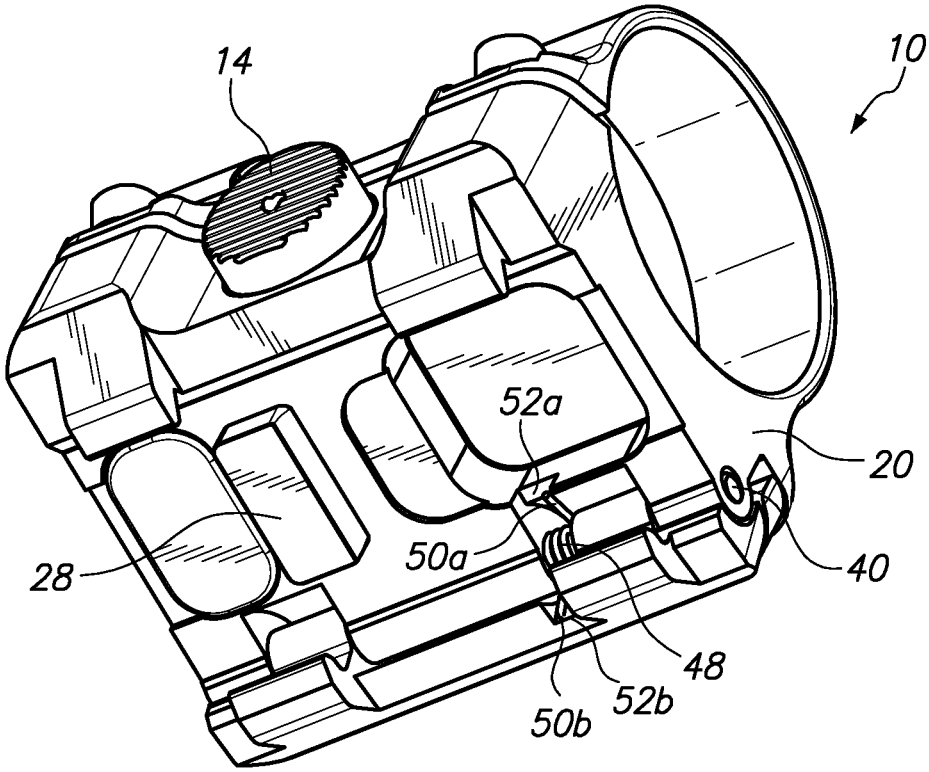
FIG. 4 is a bottom perspective view of the first embodiment of the quick detachable mount shown in FIG. 1.
Figure 7:
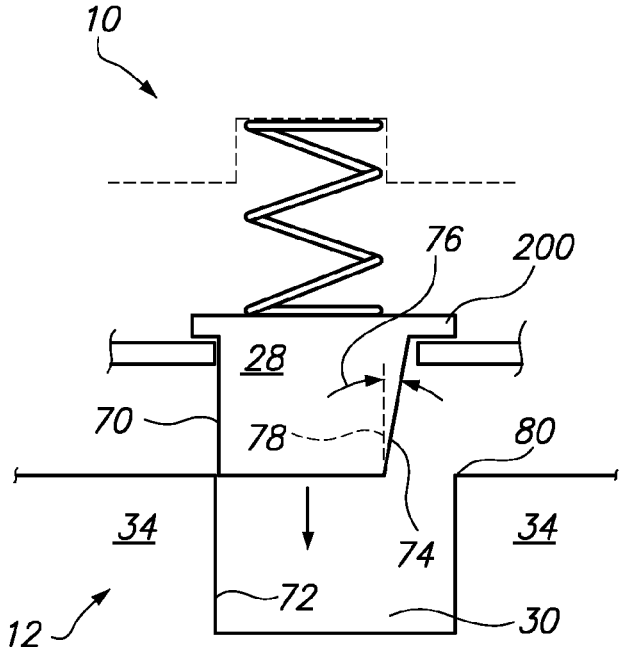
FIG. 7 is a cross-sectional view of the adjustable detent of FIG. 6.

The pivoting jaw 24 and the stationary jaw 26 limit the lateral movement of the quick disconnect mount 10 on the rail 12. The bottom side of the quick disconnect mount 10 may have a detent 28 that fits within one groove 40 between adjacent transverse ridges 34 of the rail 12 as shown in FIG. 4. To mount the quick disconnect mount 10 to the rail 12, the user opens the pivoting jaw 24 to the disengaged position so that the jaws 24, 26 can clear the opposed extensions 36 of the rail 12. The detent 28 is aligned to one of the grooves 30, as shown in FIG. 7. The detent 28 may be spring loaded so that the detent can fill the entire width of the groove 30 and limit longitudinal movement. As the detent 28 enters the groove 30, a first surface 70 of the detent 28 contacts a first surface 72 of the groove 30. A second surface 74 of the detent 28 is at a skewed angle with respect to the first surface 70. By way of example and not limitation, the angle 76 of the second surface 74 of the detent 28 may be between 5° and 20° and is preferably at 10° from a vertical plane 78 which is parallel to the first surface 70. When the detent 28 is being inserted into the groove 30, the detent 28 is inserted into the groove 30 until the corner 80 of the transverse ridge 34 contacts the second surface 74. The detent 28 ceases to be inserted further into the groove 30 but the quick disconnect mount 10 continues to be seated on to the rail 12 since the opposed pivoting jaw 24 and the stationary jaw 26 must be seated to and engage the opposed extensions 36 of the transverse ridge 34. In this manner, the self-adjusting detent 28 limits longitudinal movement of the quick disconnect mount 10 along the rail 12. Because the angle 76 is shallow, a longitudinal force applied to the quick disconnect mount 10 does not cause the detent 28 to shift upward. The quick disconnect mount 10 will not shift front to back along the rail 12.

Figure 6:
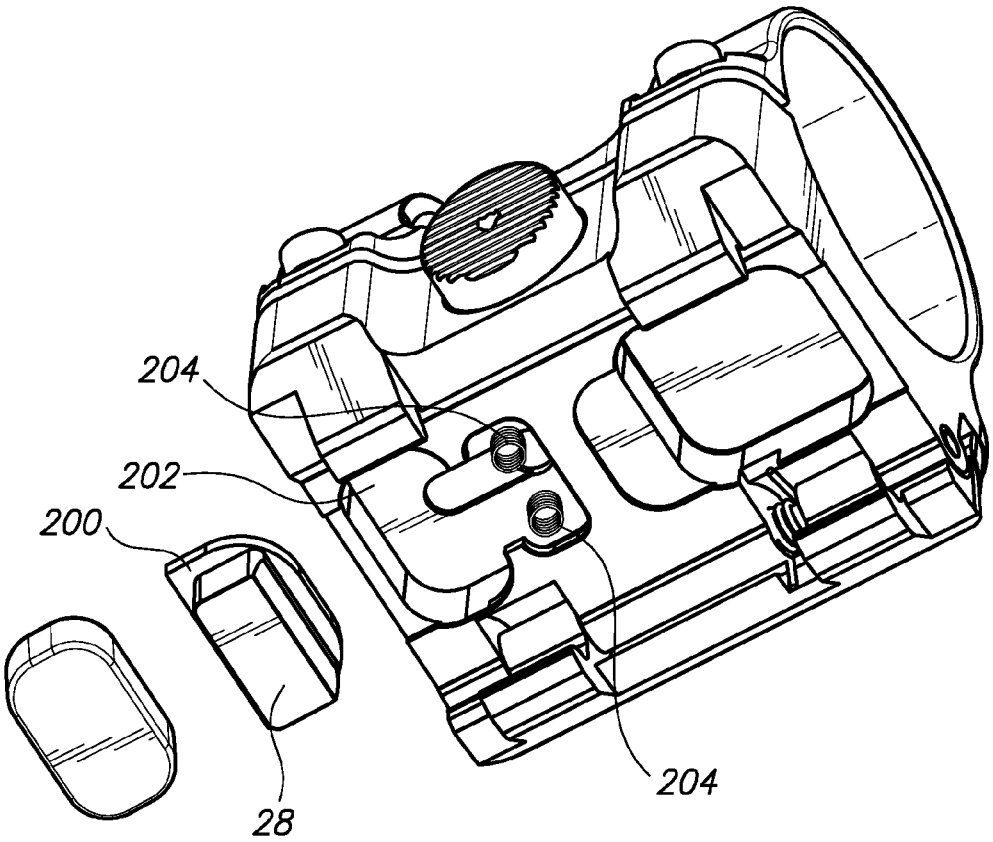
FIG. 6 is a bottom perspective view of the first embodiment of the quick detachable mount with an adjustable detent exploded off of a body of the mount.

The detent 28 may be mounted to the body 20 of the quick disconnect mount 10. The detent 28 may have a lip 200 that circumscribes the detent 28 which protrudes out from the underside of the body 20, as shown in FIGS. 3, 4 and 6. The underside of the body 20 may have an opening 202 which is sized and configured to receive the lip 20 of the detent 28. With two springs 204 disposed within a cavity of the body 20, the lip 200 is inserted into the opening 202 and slid toward and under the springs 204. The springs 204 bias the detent 28 outward. A cap is placed over the opening 202 and retained in place through means known in the art or developed in the future (e.g., adhesive, sonic welding, etc.).

Figure 8:
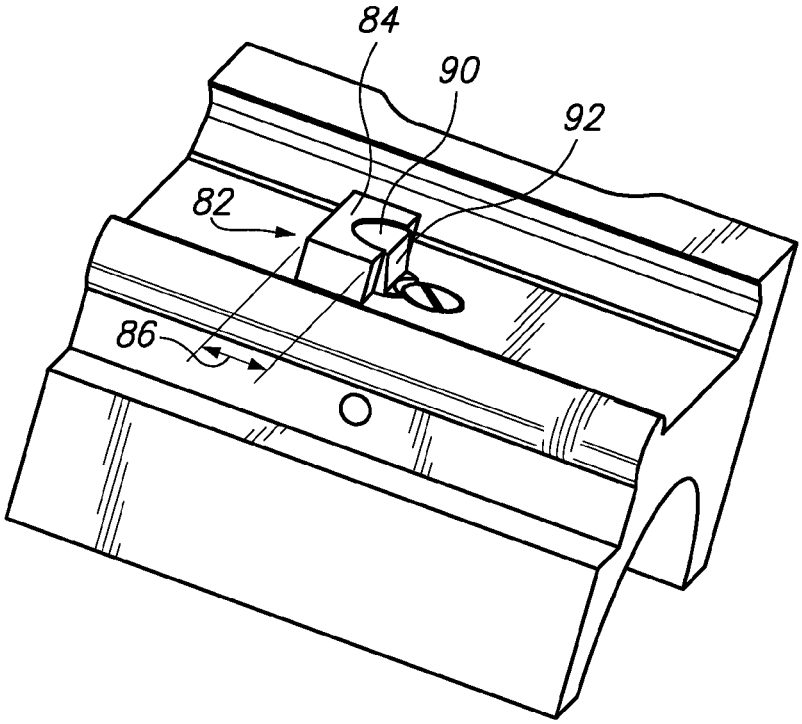
FIG. 8 is a bottom perspective view of a second embodiment of the quick detachable mount.

Another type of detent 82 is shown in FIG. 8. The detent 82 has a fixed portion 84 that has a width 86 that is smaller than a width 88 of the groove 30. The fixed portion 84 of the detent 82 is fully inserted into the groove 30 between the transverse ridges 34 that define the groove 30. However since the width 86 of the fixed portion 84 is smaller than the width 88 of the groove 30, the quick disconnect mount 10 can still slide forward and backward on the rail 12. The adjustable portion 90 of the detent 82 is spring loaded and behaves similar to the detent 28 discussed above to prevent longitudinal movement.

When attaching the quick disconnect mount 10 to the rail 12, the fixed portion 84 is fully inserted into the groove 30. However, the adjustable portion may be inserted into the groove 30 until the corner 80 of the transverse ridge 34 contacts a front angled surface 92. When the corner 80 contacts the front angled surface 92, the adjustable portion 90 no longer is inserted into the groove 30. Rather, the adjustable portion 90 is depressed into the body 20 of the quick disconnect mount 10. The angled surface 92 is at an angle 96 which is about 5° to 20°, and preferably at 10° from a vertical plane 94.

Figure 9:
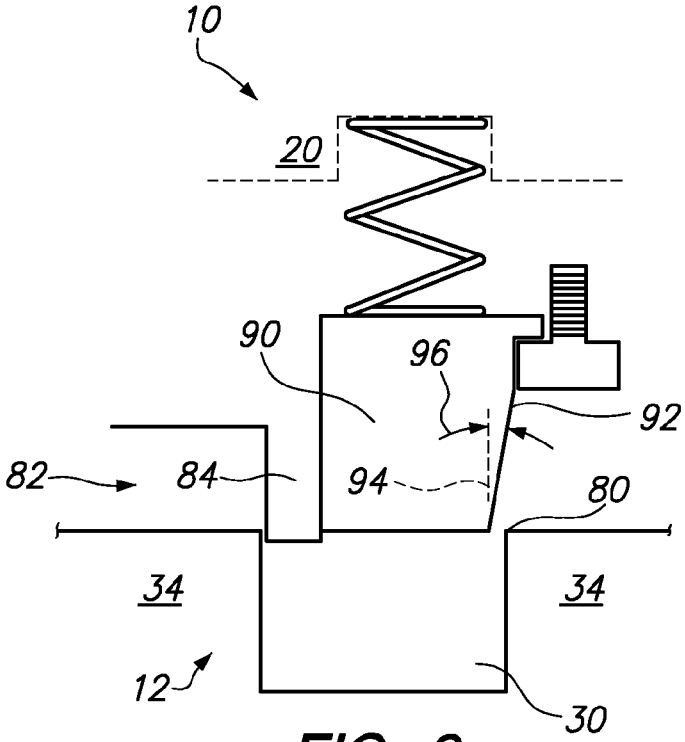
FIG. 9 is a cross-sectional view of the detent shown in FIG. 8.

The fixed portion 84 of the detent 82 may be integrally formed as part of the body 20. The adjustable portion 92 may be inserted in a cavity formed in the body 20 and the fixed portion 84, as shown in FIG. 8. A spring (see FIG. 9) may be disposed behind the adjustable portion 92 to bias the adjustable portion outward. The adjustable portion is held in place by a screw as shown in FIG. 8.

The detents 28, 82 are optional and are not required for operation of the mounts discussed herein. The detents 28, 82 provide interference so that the mounts are not inadvertently slipped off of the rail 12 in the longitudinal direction. The detents 28, 82 are adjustable. However, it is also contemplated that fixed detents may be incorporated into the mount discussed herein. The fixed detents would be narrower than the grooves. Moreover, it is contemplated that the jaws 24, 26 and jaws 124, 126 discussed below may apply sufficient force to the rail 12 so that friction holds the mount to the rail. It is also contemplated that the rails may have teeth which mate with corresponding teeth formed on the jaws 24, 26, 124, 126 to prevent longitudinal movement of the mount along the rail 12.

Referring now to FIG. 10, a second embodiment of the mechanism for the quick detachable mount 110 is shown. The button 114 for traversing the pivoting jaw 124 is not on the opposed side of the body 120 from the pivoting jaw 124. Rather, the button 114 is located on an adjacent side 100 of the body 120 with respect to the pivoting jaw 124. To operate the quick detachable mount 110, the user depresses the button 114 with a thumb while holding the quick detachable mount 110 on the opposing side 102 with his or her index or middle finger (or vice versa). Upon depressing the button 114, the pivoting jaw 124 opens up to the disengaged position in the direction of arrow 102. Upon release of the button 114, an internal camming mechanism discussed below forces the pivoting jaw 124 to the engaged position as shown in FIG. 10.

Figure 11:
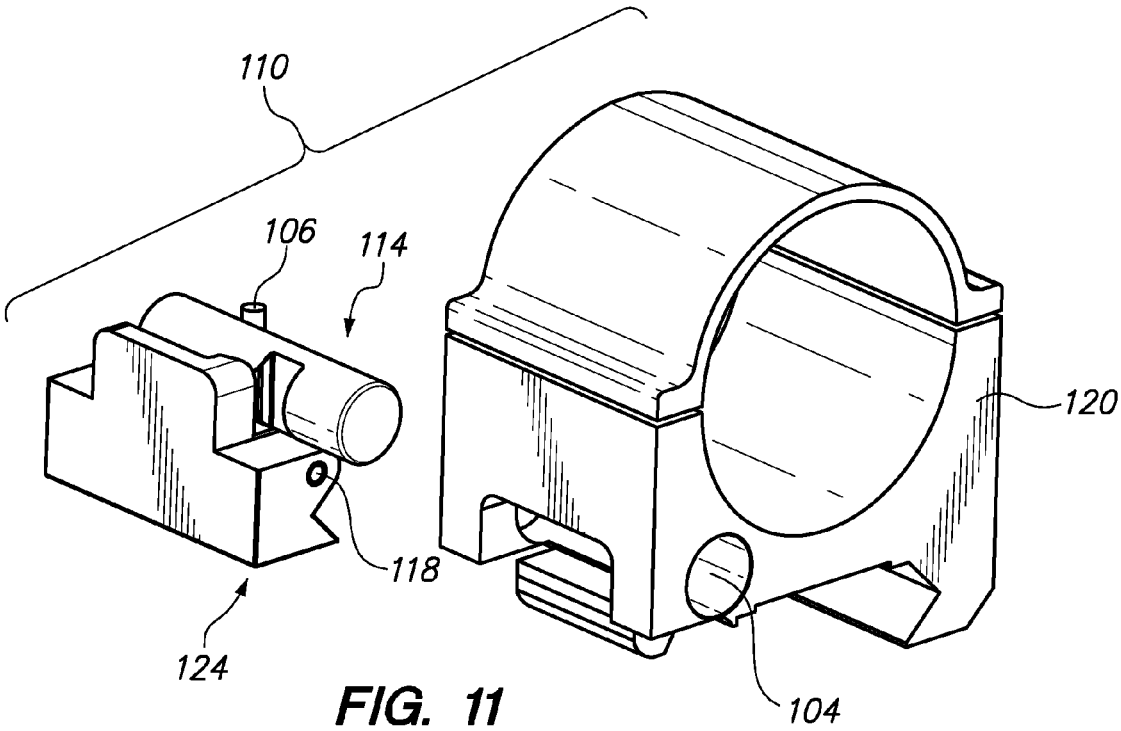
FIG. 11 is a perspective view of an internal camming mechanism of the second embodiment of the quick detachable mount shown in FIG. 10.
Figure 12:
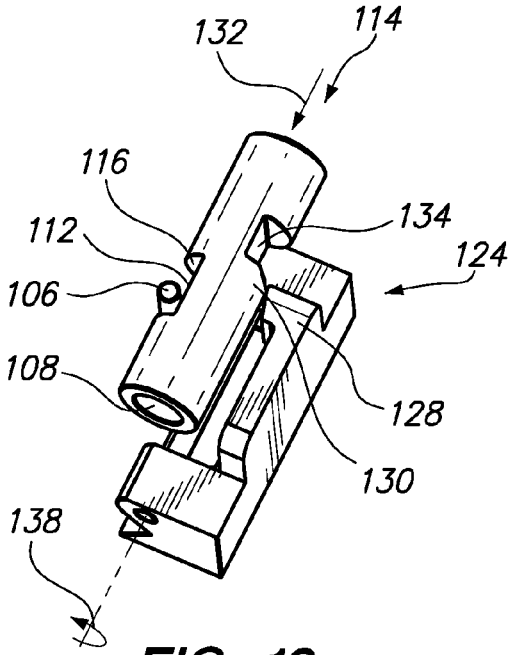
FIG. 12 is a top perspective view of the internal camming mechanism shown in FIG. 11.
Figure 13:
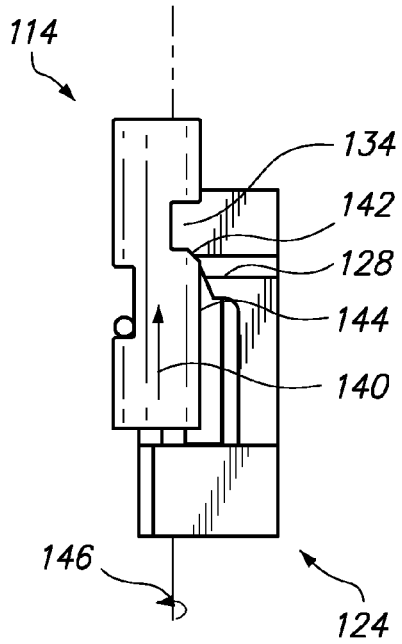
FIG. 13 is a top view of the internal camming mechanism shown in FIG. 12.

Referring now to FIG. 11 an exploded view of the quick detachable mount 110 is shown. The button 114 is disposable within hole 104 formed in the body 120. The button 114, as shown in FIGS. 11 and 12 is locked in the body 120 by way of locking pin 106. The button 114 is biased to the out-position as shown in FIG. 10 by way of a coil compression spring that is disposed within recess 108 (see FIG. 12) and pushes against the opposing side 102 of the body 120. To install the button 114, the spring and the button 114 are disposed within the hole 104. The locking pin 106 is received within a through hole formed in the body 120 and disposed within slot 112 of the button 114. Longitudinal traversal of the button 114 is limited by a length of the slot 112 and pin 106. The pin 106 may be held in place in the body by adhesive, swaging or other methods known in the art or developed in the future. In FIG. 12, the button 114 is shown as being in the out-position. When the button 114 is depressed, the button 114 may be traversed inward to the in-position until the pin 106 bumps up against a side 116 of the slot 112.

The pivoting jaw 124 is mounted to the body 120 with pin 118 (see FIG. 11). The pivoting jaw 124 rotates about the pin 118. When the button 114 is in the out-position, as shown in FIG. 10, the pivoting jaw 124 is in the engaged position. Moreover, referring to FIG. 12, the pivoting jaw 124 has a cam follower 128 that rests on the exterior surface 130 of the button 114. The exterior surface 130 of the button 114 is configured to push the cam follower 128 outward and traverse the pivoting jaw 124 to the engaged position. When the button 114 is depressed by applying force to the button 114 in the direction of arrow 132, the cam follower 128 is lined up with slot 134. The pivoting jaw 124 may be biased to the disengaged position or in the direction of arrow 138 with a torsion spring in a similar manner compared to mount 10. When the cam follower 128 is lined up with the slot 134, the biasing force (e.g. torsion spring) applied to the pivoting jaw 124 pushes the cam follower 128 into the slot 134 and pivots the pivoting jaw 124 to the disengaged position.

When the button 114 is released, the button 114 is traversed to the out-position in the direction of arrow 140. The slot 134 is defined by an angled surface 142. The angled surface 142 and a camming surface 144 engage one another and push the cam follower 128 outward thereby pivoting the pivoting jaw 124 in the direction of arrow 146 to traverse the pivoting jaw 124 back to the engaged position.

Figure 14:
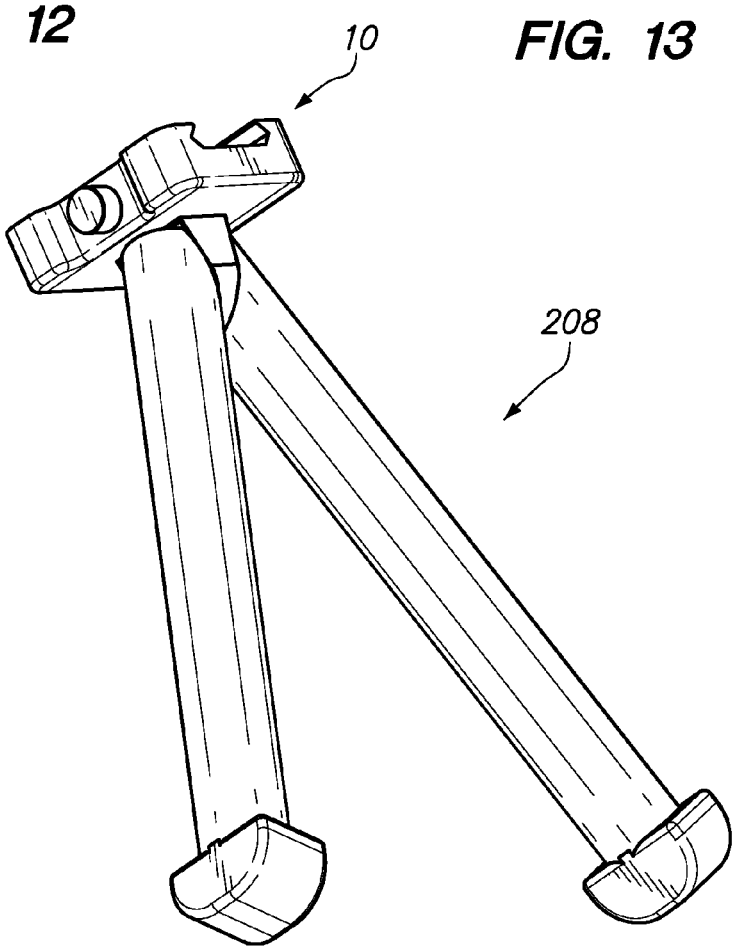
FIG. 14 illustrates that the quick detachable mount may be configured for a bi-pod.
Figure 15:
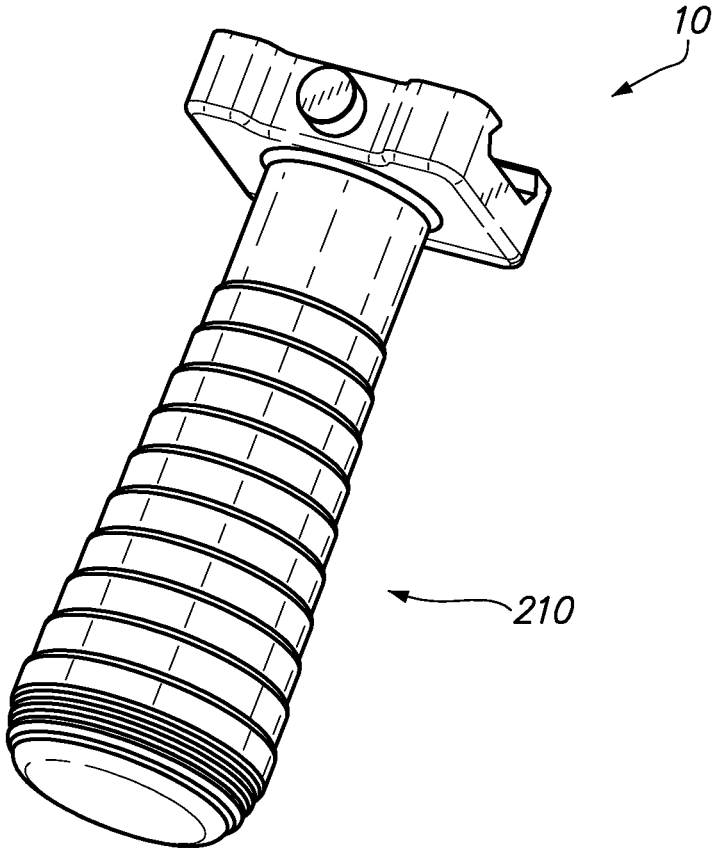
FIG. 15 illustrates that the quick detachable mount may be configured for a handle.

As discussed above, the quick disconnect mount 10 has been illustrated in relation a mount 10 capable of mounting a flashlight to a rail. However, the quick disconnect mount may be utilized for mounting other objects to a rail in other orientations and configurations. Referring now to FIG. 14, the quick disconnect mount 10 may be reconfigured to mount a bi-pod 208 to a rail disposed on an underside of a barrel of a firearm. The bi pod 208 is used to provide a forward rest and reduce motion. In another embodiment, the quick disconnect mount 10 may be reconfigured to mount a handle 210 to a rail disposed on an underside of a barrel of firearm. Moreover, the quick disconnect mount 10 may be configured to interconnect a camera to a tripod. A rail may be screwed onto an underside of the camera. A top of the tripod may have the quick disconnect mount 10. The camera and the tri pod may be removed with one hand by depressing the button on the quick disconnect mount 10.

The rail 12 shown and described herein may be a picatinny rail or a weaver rail. However, other rails systems are also contemplated. If other rail systems or connection systems are utilized, then the jaws 24, 26, 124, 126 may be modified to fit the rail system in use.

The mounts 10 and 100 shown and described herein had one fixed jaw 26 and one pivoting jaw 24. It is also contemplated that the fixed jaw 26 may be configured to be pivoting.

The above description is given by way of example, and not limitation. Given the above disclosure, one skilled in the art could devise variations that are within the scope and spirit of the invention disclosed herein, including various ways of configuring the straps 64. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A quick detachable mount removably attachable to a rail, the mount comprising:

a body;

a first jaw attached to the body;

a second jaw pivotally attached to the body between an engaged position and a disengaged position;

a wedge having an angled surface wherein the wedge is traversable between an in-position and an out-position, the angled surface being in sliding contact with the second jaw to traverse the second jaw from the disengaged position to the engaged position as the wedge is traversed from the out-position to the in-position;

a detent disposed between the first and second jaws, the detent being depressible between a normally biased out-position and a depressed position, the detent having a lower width smaller than a width of a groove of a picatinny rail and an upper width greater than the width of the groove of the picatinny rail so that upon mounting the mechanism to the picatinny rail, the detent is depressed until the width of the detent matches the width of the groove of the picatinny rail.

2. The mechanism of claim 1 wherein the second jaw is biased to the disengaged position.

3. The mechanism of claim 1 wherein the second jaw is biased toward the disengaged position with a spring.

4. The mechanism of claim 3 wherein the spring is a torsion spring which has first and second legs, the first leg presses against the second jaw and the second leg presses against the body to bias the second jaw to the disengaged position.

5. The mechanism of claim 1 wherein the wedge is biased toward the in-position with a spring.

6. The mechanism of claim 5 wherein the spring is a compression coil spring.

7. The mechanism of claim 1 further comprising:

a depressible button wherein the wedge and the second jaw are disposed on a first side of the body and the button is disposed on a second opposed side of the body, the depressible button being biased with a compression coil spring toward a non-depressed state;

a shaft extending through the body and attached to the wedge and the depressible button for traversing the wedge from the in-position to the out-position when the depressible button is depressed from the non-depressed state to a depressed state.

8. The mechanism of claim 1 further comprising:

a depressible button disposed on a first surface of the body between the first and second jaws;

a second surface of the body opposite the first surface being configured so that a user may depress the button by gripping the button and the second surface to open the second jaw.

9. The mechanism of claim 1 wherein the angled surface has a curved cross sectional configuration, a straight cross sectional configuration, a cross sectional configuration having at least two different flat angled surfaces or combinations thereof.

10. The mechanism of claim 1 wherein a mating contact surface of the pivoting second jaw contacts the angled surface, the mating contact surface having a curved cross sectional configuration, a straight cross sectional configuration, a cross sectional configuration having at least two different flat angled surfaces or combinations thereof.

11. The mechanism of claim 1 wherein the angled surface of the wedge and a travel direction of the wedge forms an angle of about 5 degrees to 20 degrees.

12. A nick detachable mount removably attachable to a rail, the mount comprising:

a body;

a first jaw attached to the body;

a second jaw pivotally attached to the body between an engaged position and a disengaged position;

a wedge having an angled surface wherein the wedge is traversable between an in-position and an out-position, the angled surface being in sliding contact with the second jaw to traverse the second jaw from the disengaged position to the engaged position as the wedge is traversed from the out-position to the in-position;

a detent disposed between the first and second jaws, the detent having a fixed portion and a depressible portion traversable between a normally biased out-position and a depressed position, the fixed portion and the depressible portion collectively having a lower width smaller than a width of a groove of a picatinny rail and an upper width greater than the width of the groove of the picatinny rail so that upon mounting the mechanism to the picatinny rail, the fixed portion is fully inserted between traverse ridges of the picatinny rail and the depressible portion is depressed until the width of the fixed and depressible portions match the width of the groove of the picatinny rail.

* * * * *